US007500850B1

(12) United States Patent
Fontaine

(10) Patent No.: US 7,500,850 B1
(45) Date of Patent: Mar. 10, 2009

(54) LIGHTER WITH ACCESSORY

(75) Inventor: Walter G. Fontaine, Narragansett, RI (US)

(73) Assignee: Colibri Corporation, Providence, RI (US)

( * ) Notice: Subject to any disclaimer, the term of this patent is extended or adjusted under 35 U.S.C. 154(b) by 622 days.

(21) Appl. No.: 11/192,790

(22) Filed: Jul. 29, 2005

(51) Int. Cl.
*F23Q 2/32* (2006.01)

(52) U.S. Cl. ..... 431/253; 431/255

(58) Field of Classification Search ..... 431/253, 431/255, 277, 344
See application file for complete search history.

(56) References Cited

U.S. PATENT DOCUMENTS 1,831,014 A * 11/1931 Leitheuser ..... 206/88
D302,336 S 7/1989 Erickson
4,947,873 A 8/1990 Wang
5,364,263 A * 11/1994 Doo-Seok ..... 431/253
5,894,597 A * 4/1999 Schwartz et al. ..... 455/558
6,074,199 A 6/2000 Song
7,306,159 B1 * 12/2007 Rochelo ..... 235/492
2001/0034002 A1 10/2001 Jager-Muench
2004/0233629 A1 * 11/2004 Wang et al. ..... 361/684
2005/0053883 A1 3/2005 Faber
2005/0130090 A1 * 6/2005 Santoro ..... 431/253

* cited by examiner

*Primary Examiner*—Alfred Basichas
(74) *Attorney, Agent, or Firm*—Salter & Michaelson

(57) ABSTRACT

A cigarette or cigar lighter has a housing containing an ignition source and means for selectively activating the ignition source to produce a flame, in combination with an electronic memory device. A door is coupled to the housing and adapted to have open and closed positions and has means defining a pocket therein for receiving the electronic memory device with the electronic memory device extending partially from the pocket. The pocket receives the electronic memory device in the open position of the door. The door is adapted to be closed by a user to integrate the door and electronic memory device with the lighter.

21 Claims, 7 Drawing Sheets

LIGHTER WITH ACCESSORY

TECHNICAL FIELD

The present invention relates to cigarette or cigar lighters and pertains, more particularly, to a lighter that is adapted to carry an accessory in an integrated manner with the lighter. The present invention also relates to a lighter that integrates therewith a memory stick, or the like.

BACKGROUND OF THE INVENTION

A memory device is used to store information relating to text or picture data and in one form is referred to as a memory stick. A memory stick is used to store information and is meant to be plugged into a port of a computer device to either download the information or to have information stored therein. It is typical for these memory sticks to be carried in the users pocket or in some other type of storage case. These memory devices are typically small and can be easily lost or misplaced when carried by a person.

Accordingly, it is an object of the present invention to provide a lighter with an integrated memory device.

Another object of the present invention is to provide a lighter with a means for receiving and retaining a memory stick.

A further object of the present invention is to provide a combination lighter and memory stick in which the memory stick is held in place integrated with the lighter and is thus far less likely to be lost or misplaced.

Still another object of the present invention is to provide a combination lighter and memory device that is compact.

Still a further object of the present invention is to provide a combination lighter and memory device wherein the memory device is readily storable in the lighter and readily retrievable therefrom.

SUMMARY OF THE INVENTION

To accomplish the foregoing and other objects, features and advantages there is provided in accordance with the present invention a lighter that comprises a housing containing an ignition source and a switch on the housing for selectively activating the ignition source to produce a flame. A door is coupled to the housing and adapted to have open and closed positions and has means defining a pocket therein for receiving a memory stick that extends partially from the pocket. The pocket receives the memory stick in the open position of the door. The door is adapted to be closed by a user to integrate the door and memory stick with the lighter.

In accordance with other aspects of the present invention the lighter may include a pivot for coupling the door to the housing to enable the door to be pivoted towards and away from the housing. The ?away? position of the door may correspond to the open position of the door and the ?towards? position of the door may correspond to the closed position of the door when the door is fully closed and engages the housing. The housing may also include a pair of sidewalls that define therebetween a recess for receiving the door in the closed position of the door. The door and recess may have detent means that hold the door in the closed position. The detent means may include a hole and mating projection between the sidewalls and the door. A cover on the memory stick covers a portion of the memory stick that is not disposed within the pocket. The cover may have a hole for receiving a projection on the sidewalls for holding the door in the closed position. Each sidewall may have a projection and opposite sides of the cover each may have a hole for receiving a corresponding projection.

In accordance with another embodiment of the present invention there is provided a lighter that comprises a housing containing an ignition source and means for selectively activating the ignition source to produce a flame. A door is coupled to the housing and has means defining a pocket therein for receiving an electronic memory device that extends partially from the pocket. The door is adapted to be closed by a user to integrate the door and memory device with the lighter and opened to present the memory device for withdrawal from the pocket.

In accordance with other aspects of the present invention the lighter may include a pivot for coupling the door to the housing to enable the door to be pivoted towards and away from the housing. The housing may include a pair of sidewalls that define therebetween a recess for receiving the door in the closed position of the door. The door and recess may have detent means that hold the door in the closed position. The lighter may also include a cover on the memory device that covers a portion of the memory device that is not disposed within the pocket. The cover may have a hole for receiving a projection on the sidewalls for holding the door in the closed position.

In accordance with another embodiment of the present invention there is provided a cigarette or cigar lighter that has a housing containing an ignition source and means for selectively activating the ignition source to produce a flame, in combination with an electronic memory device. A door is coupled to the housing and adapted to have open and closed positions and has means defining a pocket therein for receiving the electronic memory device with the electronic memory device extending partially from the pocket. The pocket receives the electronic memory device in the open position of the door. The door is adapted to be closed by a user to integrate the door and electronic memory device with the lighter.

In accordance with other aspects of the present invention the lighter may include a pivot for coupling the door to the housing to enable the door to be pivoted towards and away from the housing. The housing may include a pair of sidewalls that define therebetween a recess for receiving the door in the closed position of the door. The door and recess may have detent means that hold the door in the closed position. The lighter may also include a cover on the memory device that covers a portion of the memory device that is not disposed within the pocket.

DESCRIPTION OF THE DRAWINGS

Numerous other objects, features and advantages of the present invention are realized by reference to the following detailed description, taken in conjunction with the accompanying drawings, in which.

DETAILED DESCRIPTION

Figure 1:
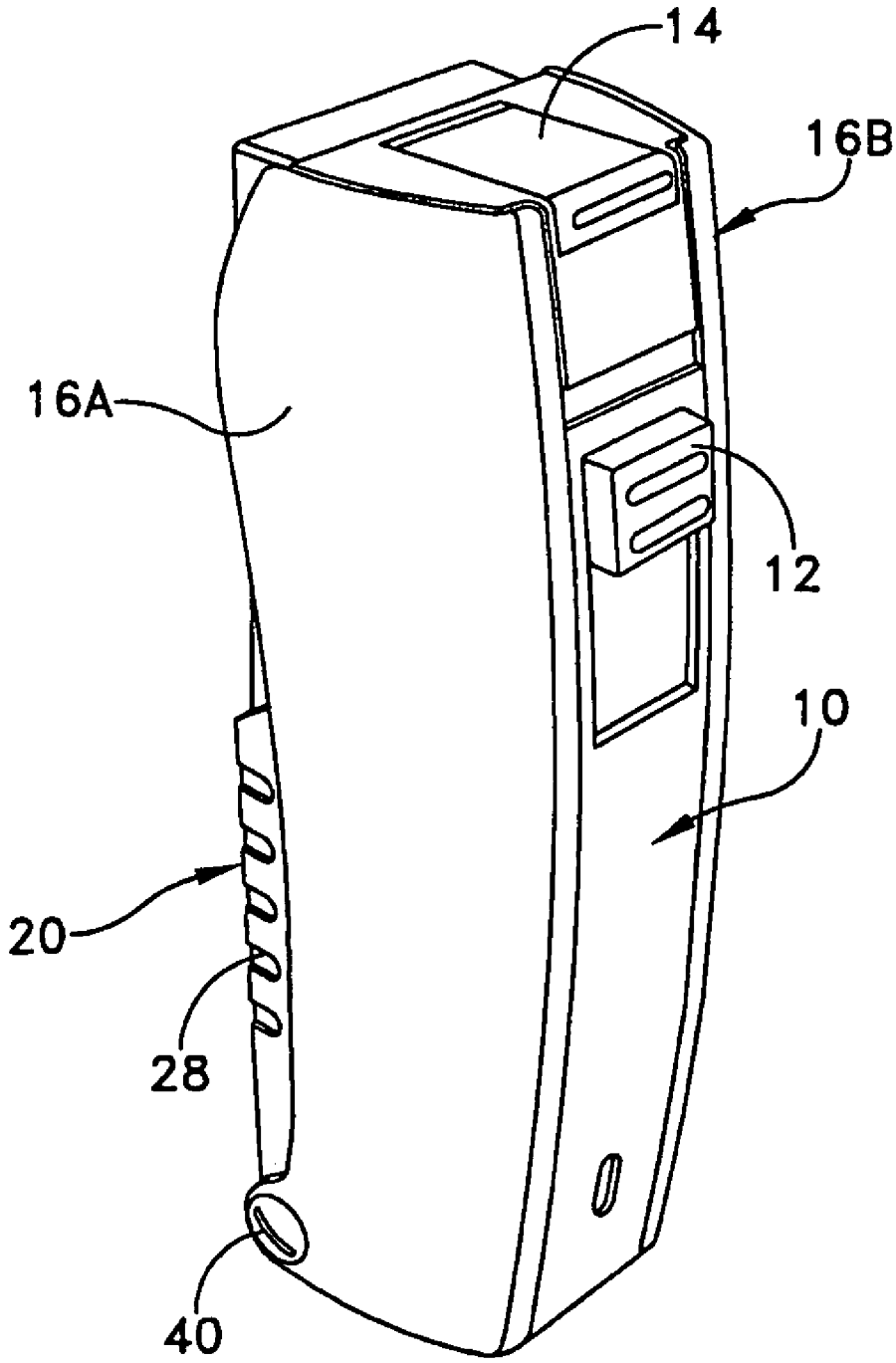
FIG. 1 is a perspective view of one embodiment of a lighter constructed in accordance with the present invention.

As has been mentioned before, a memory device is used to store information relating to text or picture data and in one form is referred to as a memory stick. A memory stick is used to store information and is meant to be plugged into a port of a computer or other electronic device to either download the information or to have information stored therein. These memory devices are typically small and can be easily lost or misplaced when carried by a person. An objective of the present invention is to effectively integrate a memory stick or the like with a lighter, typically a cigarette or cigar lighter.

Refer to the drawings for further details of one embodiment of the invention in which the lighter itself may be basically of conventional design including a lighter housing 10, an ignition switch 12 and a lid 14. The lid 14 may be manually opened to expose an ignition jet 13 from which a flame is generated upon operation of the switch 12. The ignition switch 12 is typically slid downwardly to produce the flame. The housing also includes a reservoir (shown in dotted outline in FIG. 2) for the ignition fluid. As a majority of the lighter may be considered of conventional design much of the detail of the lighter is not shown herein. Refer to the present assignees prior U.S. Pat. Nos. 5,888,061; 6,632,082 and 6,875,013 for further details of lighter constructions. These three patents are hereby incorporated by reference herein in their entirety.

The lighter that is described herein is different than prior art constructions in that it now includes means for supporting and receiving a memory stick or the like memory or electronic device. This includes providing opposite sidewalls 16A and 16B that define therebetween a recess 18 for receiving the door 20. The door 20 is coupled to the housing 10 and is adapted to have closed and open positions as shown in respective FIGS. 1 and 8. The door 20 has means defining a pocket 24 therein for receiving a memory stick 30 that extends partially from the pocket 24. The door 20 may have a height of about one half the height of a sidewall 16 of the housing 10. The pocket 24 receives the memory stick 30 in an open or partially open position of the door 20. The door 20 is adapted to be closed by a user, once the memory stick has been inserted in the door, to integrate the door and memory stick with the lighter.

Figure 4:
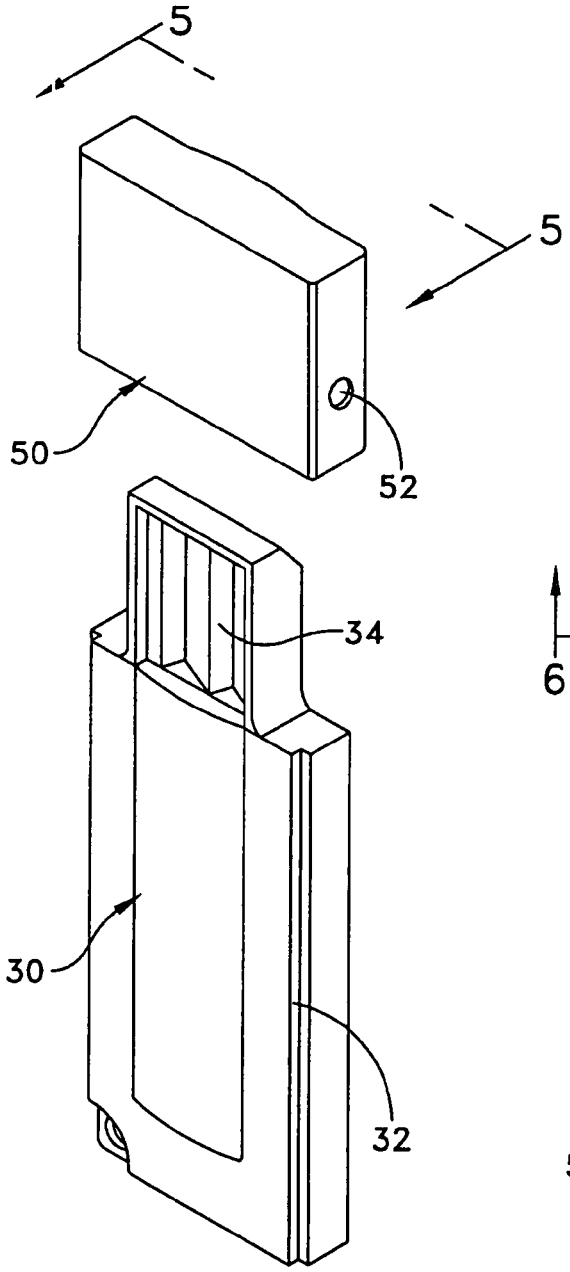
FIG. 4 is a perspective view of the memory stick and cover.

The memory stick 30 is illustrated, particularly in FIG. 4, as comprised of a main part 32 and a connector part 34. The memory stick 30 may also be considered as of conventional design and includes a memory chip typically encased in a protective plastic member having the connector part 34 at one end of the memory stick 30. The connector part 34 provides electrical connection to and from the internal memory chip.

Figure 2:
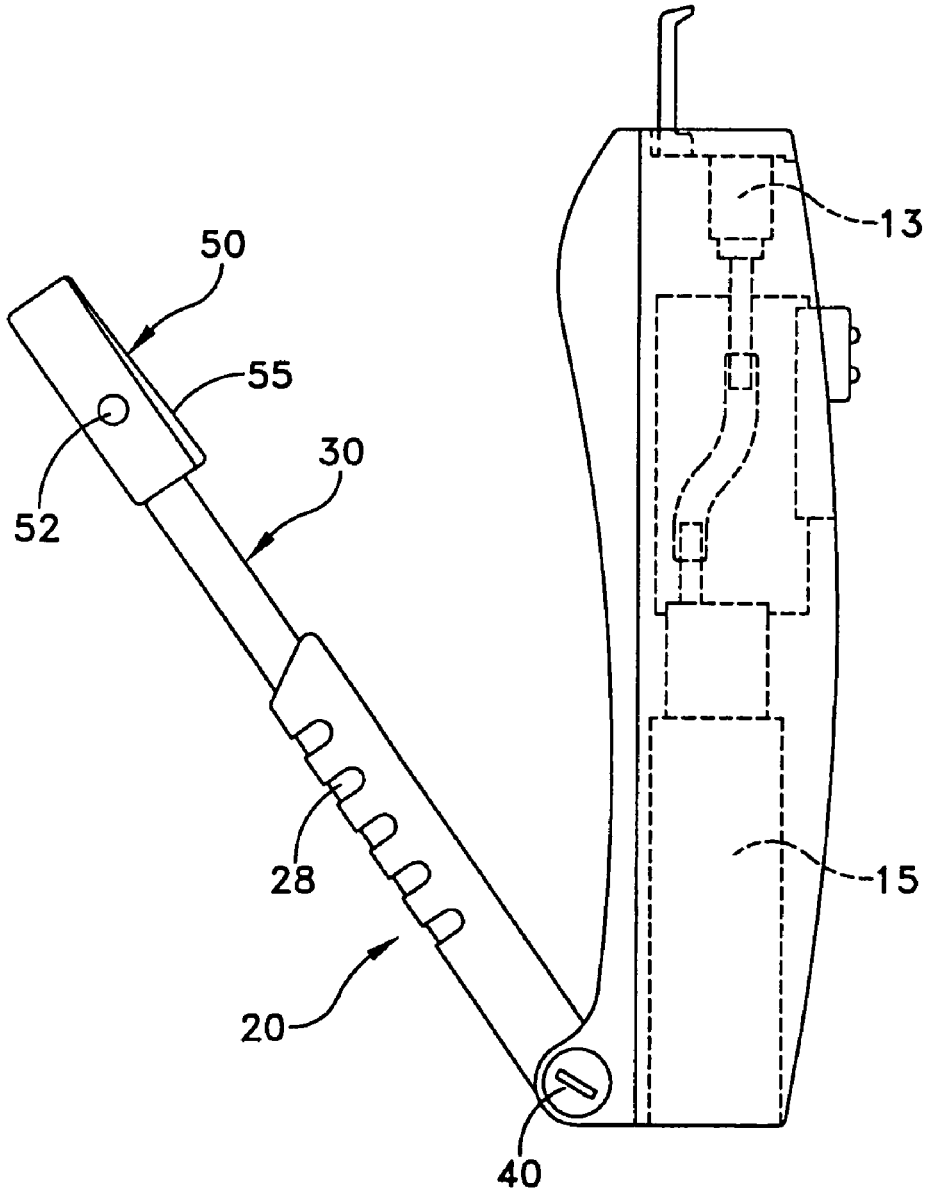
FIG. 2 is a side elevation view of the lighter of FIG. 1 with the accessory door open.
Figure 3:
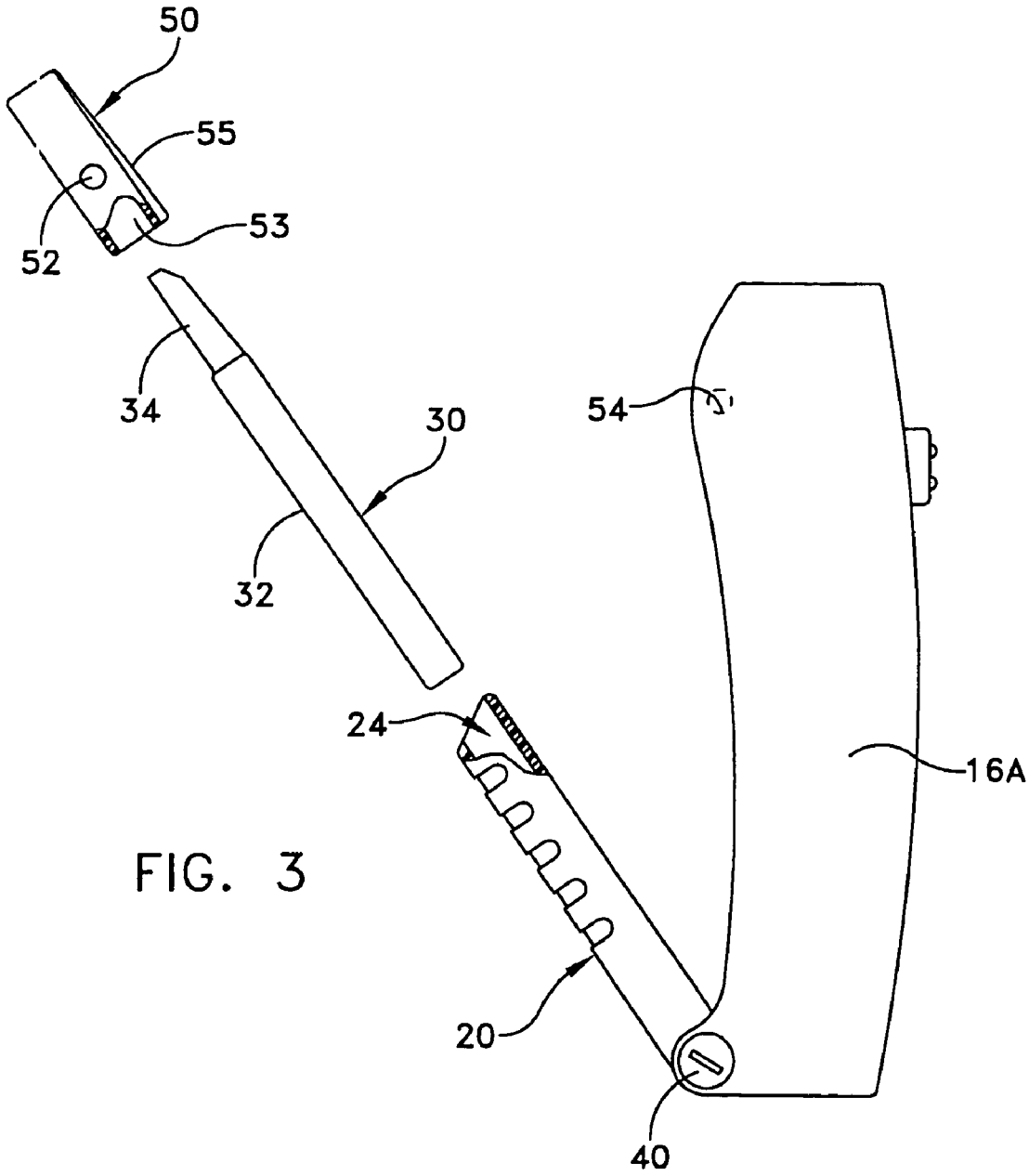
FIG. 3 is a side elevation view like FIG. 2 with the memory stick and cover exploded from the lighter.

The aforementioned door 20 is illustrated as coupled to the lighter housing by means of a pivot 40 for coupling the door 20 to the housing 10 to enable the door to be pivoted towards and away from the housing. The pivot 40 may extend between the sidewalls 16. Alternatively, there may be provided separate pivots at the respective sidewalls. The pivot 40 is for coupling the door 20 to the housing 10 to enable the door 20 to be pivoted towards and away from the housing 10. The ?away? position of the door 20 corresponds to the open position of the door 20 and the ÷towards? position of the door 20 corresponds to the closed position of the door 20 when the door 20 is fully closed and engages the housing 10. A cover 50 is provided on one end of the memory stick 30. The cover 50 covers a portion of the memory stick 30 that is not disposed within the door pocket 24. The cover 50 preferably covers the connector part 34 of the memory stick 30 as illustrated in FIGS. 2 and 3.

Figure 5:
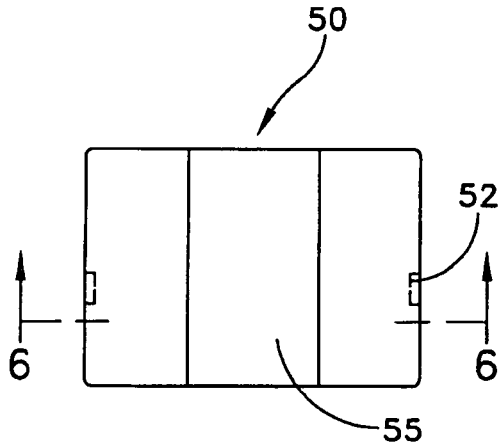
FIG. 5 is a front view of the cover.
Figure 6:
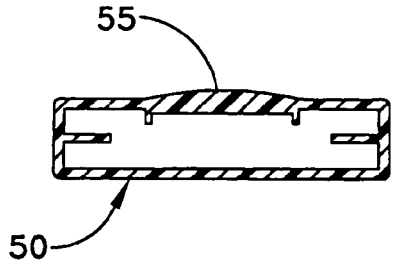
FIG. 6 is a cross-sectional view taken along line 6-6 of FIG. 5.
Figure 7:
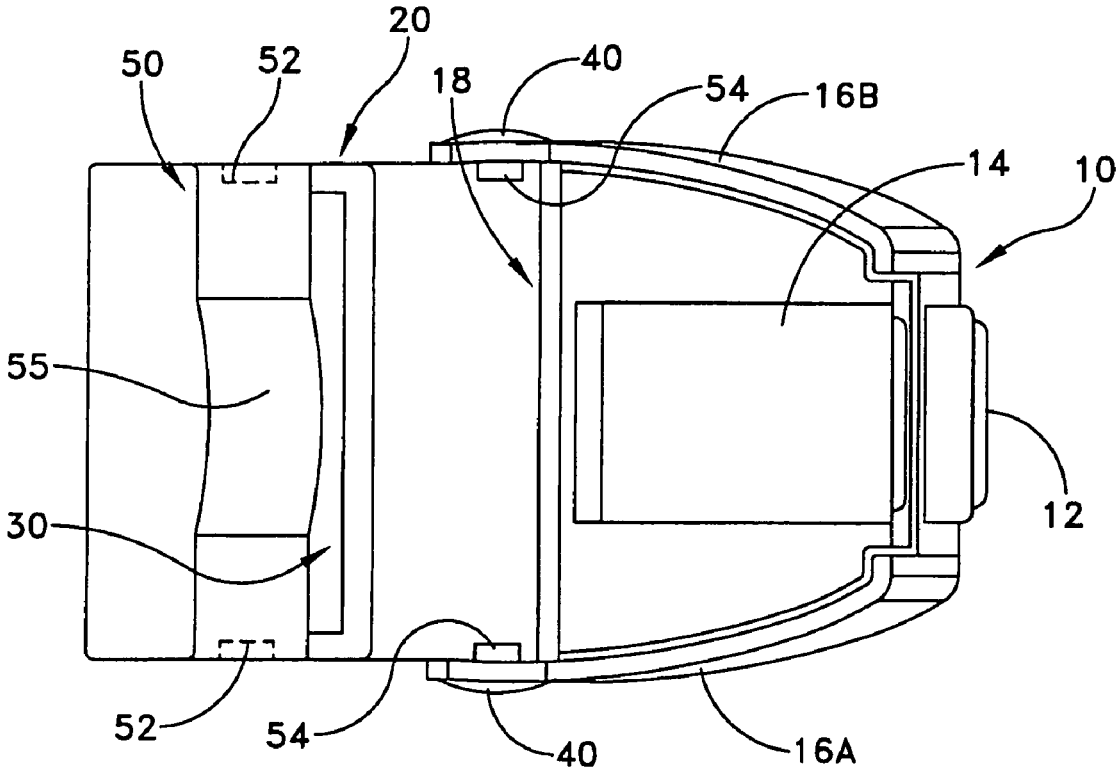
FIG. 7 is a plan view of the lighter of FIG. 1 with the door partially open.
Figure 9:
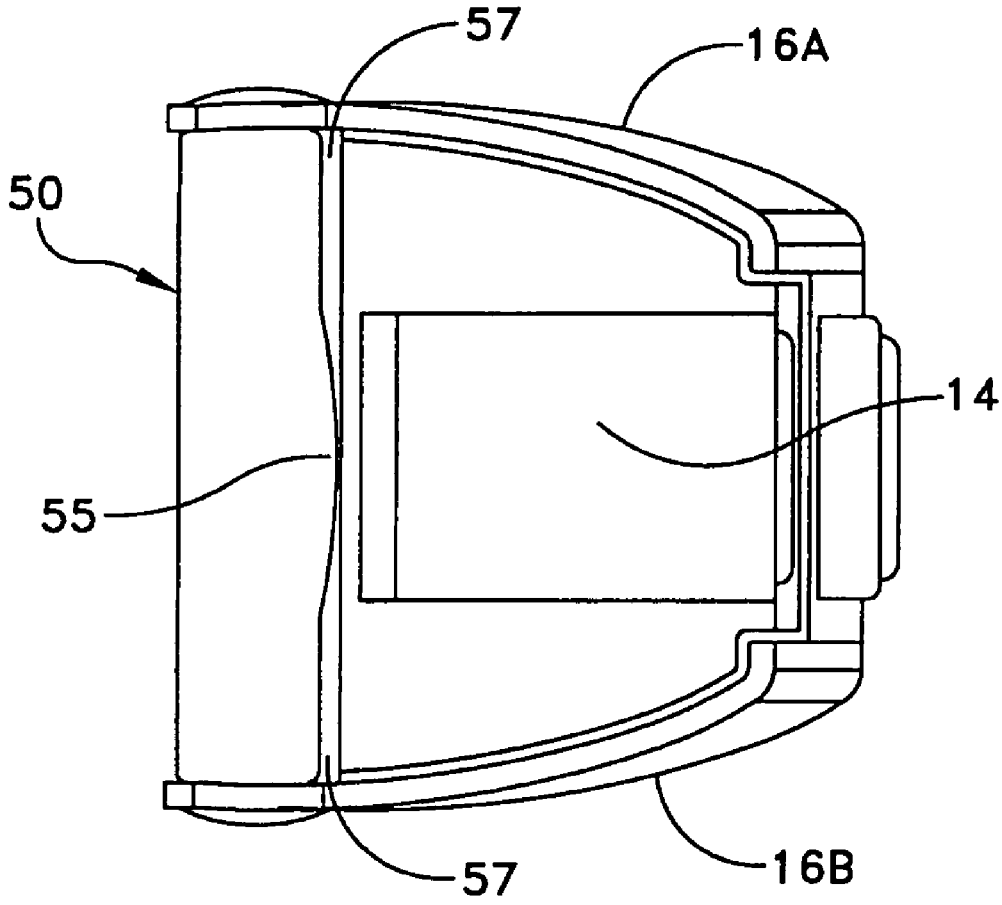
FIG. 9 is a partial plan view of the lighter in the closed position of the door illustrating the finger gaps.

The cover 50 may be slid on and off of the memory stick 30 and has a slot 53 for receiving the memory stick 30. The cover 50 has opposed holes or indentations 52 for receiving respective projections 54 on the respective sidewalls 16 for holding the door in the closed position. Each sidewall has a projection 54 and opposite sides of the cover each has a hole or indentation 52 for receiving a corresponding projection 54. The combination of the projection and the indentation provides a detent means that is useful in holding the door closed. The cover 50 is also provided with a small hump 55 (see FIGS. 5 and 6) on the side that faces the sidewall pocket. This hump defines two small gaps 57 (see FIG. 9) on either side thereof that enable a user of the lighter to easily open the door 20. A fingernail can easily fit in either of the gaps 57 to engage the door 20 and open it.

The door 20 has its pocket 24 dimensioned so that the memory stick 30 fits snugly within the pocket 24. The door 20 may be provided with cross ribs 28 that define a series of small crests inside the pocket that are urged against the memory stick to provide the snug fit.

Figure 8:
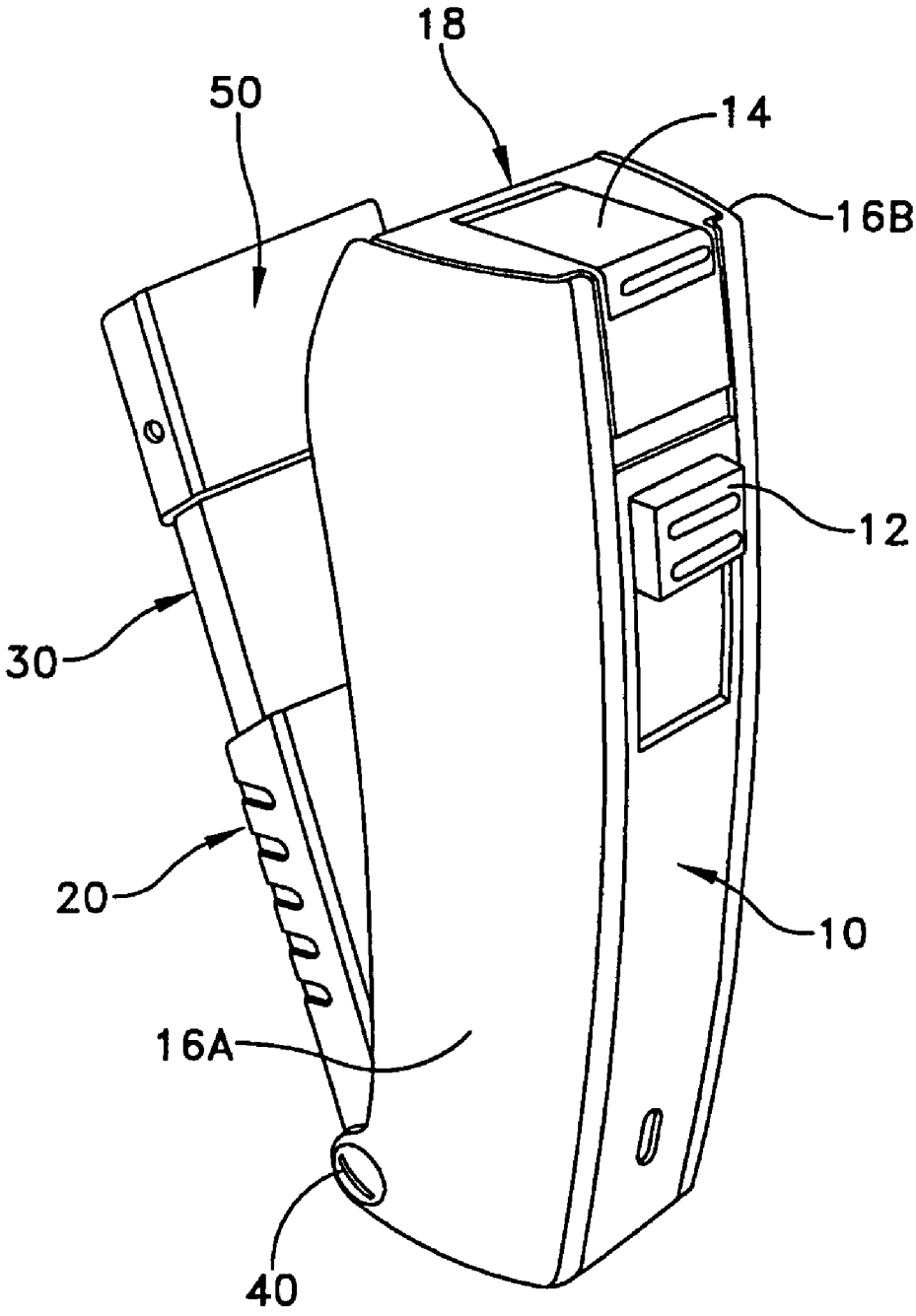
FIG. 8 is a perspective view like FIG. 1 but with the door partially open.

FIG. 1 shows the memory stick in its stored position. FIG. 2 shows the door of the lighter having been opened but with the memory stick and cover still in place in the door. FIG. 3 illustrates how the memory stick and cover can be disengaged from the door pocket. FIG. 8 shows the memory stick and cover having been reengaged with the cover about the connector end of the memory stick and with the base of the memory stick having been engaged in the pocket of the door.

Having now described a limited number of embodiments of the present invention, it should now be apparent to those skilled in the art that numerous other embodiments and modifications thereof are contemplated as falling within the scope of the present invention as defined by the appended claims. For example, the disclosed embodiments describe the retention of a memory stick, however, in other embodiments of the invention other types of electronic devices may be supported including more than just memory storage. Also, in the disclosed embodiments the cover has been shown on the connector part of the memory stick, however, the cover may also be used on the other end of the memory stick in which case the connector part is disposed in the door pocket. In still another embodiment of the invention the cover may be optional with the detect means (projection and indentation) being provided between the door and sidewalls or between the memory stick itself and the sidewalls.

What is claimed is:

1. A lighter comprising:

a housing containing an ignition source;

a switch on the housing for selectively activating the ignition source to produce a flame;

a door coupled to the housing and adapted to have open and closed positions;

said door having means defining a pocket therein for receiving a memory stick that extends partially from said pocket;

said pocket receiving the memory stick in the open position of the door;

said door having multiple enclosing walls that define therebetween the pocket;

the enclosing walls of the pocket defining a single open entry port for receiving and maintaining the memory stick in place with the electronic memory device extending partially from said pocket in both the open and closed positions of the door;

said door adapted to be closed by a user to integrate the door and memory stick with the lighter.

2. The lighter of claim 1 including a pivot for coupling the door to the housing to enable the door to be pivoted towards and away from the housing and a cover on the memory stick that covers a portion of the memory stick.

3. The lighter of claim 2 wherein the away position of the door corresponds to the open position of the door and the towards position of the door corresponds to the closed position of the door when the door is fully closed and engages the housing.

4. The lighter of claim 3 wherein the housing includes a pair of sidewalls that define therebetween a recess for receiving the door in the closed position of the door.

5. The lighter of claim 4 wherein the door and recess have detent means that hold the door in the closed position.

6. The lighter of claim 5 wherein the detent means includes a hole and mating projection between the sidewalls and the door.

7. A lighter comprising:

a housing containing an ignition source;

a switch on the housing for selectively activating the ignition source to produce a flame;

a door coupled to the housing and adapted to have open and closed positions;

said door having means defining a pocket therein for receiving a memory stick that extends partially from said pocket;

said pocket receiving the memory stick in the open position of the door;

said door adapted to be closed by a user to integrate the door and memory stick with the lighter;

including a pivot for coupling the door to the housing to enable the door to be pivoted towards and away from the housing;

wherein the away position of the door corresponds to the open position of the door and the towards position of the door corresponds to the closed position of the door when the door is fully closed and engages the housing;

including a cover on the memory stick that covers a portion of the memory stick that is not disposed within the pocket.

8. The lighter of claim 7 wherein the cover has a hole for receiving a projection on the sidewalls for holding the door in the closed position.

9. The lighter of claim 8 wherein each sidewall has a projection and opposite sides of the cover each has a hole for receiving a corresponding projection.

10. A lighter comprising:

a housing containing an ignition source and means for selectively activating the ignition source to produce a flame;

a door coupled to the housing;

said door having means defining a pocket therein for receiving an electronic device including memory that extends partially from said pocket;

said door adapted to be closed by a user to integrate the door and electronic device with the lighter and opened to present the electronic device for withdrawal from the pocket;

and a cover on the memory device that covers a portion of the memory device that is not disposed within the pocket.

11. The lighter of claim 10 including a pivot for coupling the door to the housing to enable the door to be pivoted towards and away from the housing.

12. The lighter of claim 10 wherein the housing includes a pair of sidewalls that define therebetween a recess for receiving the door in the closed position of the door.

13. The lighter of claim 12 wherein the door and recess have detent means that hold the door in the closed position.

14. The lighter of claim 10 wherein the cover has a hole for receiving a projection on the sidewalls for holding the door in the closed position.

15. In a cigarette or cigar lighter that has a housing containing an ignition source and means for selectively activating the ignition source to produce a flame, the combination with an electronic memory device, a door coupled to the housing and adapted to have open and closed positions, said door having multiple enclosing wall means defining a linearly extending single entry port pocket therein for receiving the electronic memory device with the electronic memory device extending partially from said pocket in both the open and closed positions of the door, said pocket having an axis and receiving the electronic memory device in the open position of the door by inserting the electronic memory device into the pocket in the direction of the pocket axis, said door adapted to be closed by a user to integrate the door and electronic memory device with the lighter.

16. The lighter of claim 15 including a pivot for coupling the door to the housing to enable the door to be pivoted towards and away from the housing and a cover on the memory stick that covers a portion of the memory stick that is not disposed within the pocket.

17. The lighter of claim 16 wherein the housing includes a pair of sidewalls that define therebetween a recess for receiving the door in the closed position of the door.

18. The lighter of claim 17 wherein the door and recess have detent means that hold the door in the closed position.

19. The lighter of claim 15 wherein the multiple enclosing wall means of the door includes opposed sets of walls that define a substantially rectangular pocket defining the entry port into which the electronic memory device is received.

20. The lighter of claim 19 wherein said pocket is defined by only the multiple enclosing walls means of the door.

21. In a cigarette or cigar lighter that has a housing containing an ignition source and means for selectively activating the ignition source to produce a flame, the combination with an electronic memory device, a door coupled to the housing and adapted to have open and closed positions, said door having means defining a pocket therein for receiving the electronic memory device with the electronic memory device extending partially from said pocket, said pocket receiving the electronic memory device in the open position of the door, said door adapted to be closed by a user to integrate the door and electronic memory device with the lighter and including a cover on the memory device that covers a portion of the memory device that is not disposed within the pocket.

* * * * *